US006649315B1

(12) United States Patent
Takasaki

(10) Patent No.: US 6,649,315 B1
(45) Date of Patent: Nov. 18, 2003

(54) NONMAGNETIC ONE COMPONENT DEVELOPER AND DEVELOPING METHOD

(75) Inventor: Takahiro Takasaki, Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/763,564

(22) PCT Filed: Aug. 27, 1999

(86) PCT No.: PCT/JP99/04635

§ 371 (c)(1),
(2), (4) Date: Feb. 23, 2001

(87) PCT Pub. No.: WO00/13063

PCT Pub. Date: Mar. 9, 2000

(30) Foreign Application Priority Data

Aug. 27, 1998 (JP) ..... 10-241280

(51) Int. Cl.[7] ..... G03G 9/08

(52) U.S. Cl. ..... 430/110.3; 430/110.4; 430/111.4; 430/125

(58) Field of Search ..... 430/110.2, 110.3, 430/110.4, 111.4, 125

(56) References Cited

U.S. PATENT DOCUMENTS

| | | | | |
|---|---|---|---|---|
| 5,328,792 A | | 7/1994 | Shigemori et al. | 430/106.6 |
| 5,773,185 A | * | 6/1998 | Yachi et al. | 430/137 |
| 5,952,144 A | * | 9/1999 | Hasegawa et al. | 430/109 |
| 5,958,640 A | * | 9/1999 | Hasegawa et al. | 430/104 |
| 6,171,743 B1 | * | 1/2001 | Nakamura | 430/110.3 |

FOREIGN PATENT DOCUMENTS

| | | |
|---|---|---|
| JP | 51-3244 | 1/1976 |
| JP | 58-129437 | 8/1983 |
| JP | 62-203182 | 9/1987 |
| JP | 02-000877 | 1/1990 |
| JP | 3-7972 | 1/1991 |
| JP | 03-259161 | 11/1991 |
| JP | 5-188637 | 1/1993 |
| JP | 8-022138 | 1/1996 |
| JP | 08-179603 | 7/1996 |
| JP | 08-314188 | 11/1996 |
| JP | 09-068862 | 3/1997 |
| JP | 09-090671 | 4/1997 |
| JP | 09-114129 | 5/1997 |
| JP | 09-292739 | 11/1997 |
| JP | 2-751210 | 2/1998 |
| JP | 10-177278 | 6/1998 |
| JP | 11-184147 | 7/1999 |
| JP | 11-218957 | 8/1999 |
| JP | 11-305540 | 11/1999 |

* cited by examiner

*Primary Examiner*—John Goodrow
(74) *Attorney, Agent, or Firm*—Dinsmore & Shohl LLP

(57) ABSTRACT

A non-magnetic one-component developer comprising a substantially spherical polymerized toner which contains at least a binder resin and a colorant and has features that the volume average particle diameter is 5 to 10 $\mu$m, the proportion of particles having a particle diameter of at most 5 $\mu$m is at most 25% by number, the proportion of particles having a particle diameter of at least, 16 $\mu$m is at most 2% by volume, the standard deviation of the number particle diameter distribution is at most 1.8, and the spheroidicity represented by a ratio (dl/ds) of a length (dl) to a breadth (ds) in a particle is 1.0 to 1.3, and suitable for use in a cleaning system concurrent with development, and a developing method according to thee cleaning system concurrent with development making use of the non-magnetic one-component developer.

19 Claims, 2 Drawing Sheets

NONMAGNETIC ONE COMPONENT DEVELOPER AND DEVELOPING METHOD

TECHNICAL FIELD

The present invention relates to a developing method comprising cleaning off a developer remaining on a photosensitive member by a developing device at the same time as development in an image forming apparatus such as an electrophotographic apparatus making good use of electrophotography or an electrostatic recording apparatus, and a non-magnetic one-component developer used in this developing method.

BACKGROUND ART

An image forming apparatus according to electrophotography is generally equipped with a photosensitive member (electrostatic latent image-bearing member), a means for evenly and uniformly charging the surface of the photosensitive member, an exposing means (electrostatic latent image-forming means) for writing an electrostatic latent image on the charged surface of the photosensitive body, such as a laser device, a developing means for developing the electrostatic latent image on the photosensitive member with a developer (toner), a transferring means for transferring the developer image developed to a transfer medium such as transfer paper or an OHP sheet, and a fixing means for fixing the toner image transferred on the transfer medium. Many of such conventional image forming apparatus are also equipped with a cleaning device for removing the developer remaining on the photosensitive member.

Specifically, for example, such an image forming apparatus equipped with a cleaning device as illustrated in FIG. 2 is generally used. The image forming apparatus has a structure that a cleaning device 202, a charging device 203, an exposing device 204, a developing device 205, a transferring device 206, etc. are arranged around a photosensitive member 201. In order to form an image with the image forming apparatus, the surface of the photosensitive member 201 is first evenly and uniformly charged to a plus (+) or minus (−) charge by the charging device 203. The charging device illustrated in FIG. 2 is a charger according to corona discharge. Image exposure is then conducted by the exposing device 204 to form an electrostatic latent image on the photosensitive member 201. Electric resistance is lowered at an area (exposed region) of the photosensitive member, to which light has been applied by the exposure, and so the plus or minus charge vanishes.

The electrostatic latent image formed on the photosensitive member 201 is developed by the developing device 205. The developing device 205 illustrated in FIG. 2 is constructed by a developing roller 208, a layer-thickness regulating blade 209 for developer, a developer (toner) 210, a developer feed roller 212, a casing 211 for containing these members therein, etc. The layer thickness of the developer transferred to the developing roller 208 by the rotation (rotating direction C) of the feed roller 212 is controlled by the blade 209 coming into contact with the developing roller 208, whereby a thin layer of the developer is formed on the developing roller 208. The developer on the developing roller 208 is applied to the electrostatic latent image by bringing the developing roller 208 (rotating direction B) and the photosensitive member 201 (rotating direction A), which rotate to reverse directions to each other, into contact with each other, thereby forming a developer image on the photosensitive member 201.

In the case of ordinary normal development system, a charge remains only on image portions such as characters corresponding to original due to image exposure. A developer charged to a polarity opposite to the charge of this electrostatic latent image is applied to form the developer image. The developer image on the photosensitive member 201 is electrostatically transferred to a transfer medium 207 by the transferring means 206. The transferring device illustrated in FIG. 2 is a charger according to corona discharge and serves to charge the transfer medium 207 to a polarity opposite to the developer to transfer the developer image from the surface of the photosensitive member to the transfer medium. The developer image transferred to the transfer medium 207 is fixed to the transfer medium by any of various methods such as heating, pressing and use of solvent vapor.

In the transferring step, a part of the developer. remains on the photosensitive member 201 without being transferred to the transfer medium 207. Therefore, this kind of image forming apparatus is generally equipped with a cleaning device 202 for removing the developer remaining on the photosensitive member 201. After the transferring step, the developer remaining on the photosensitive member 201 is removed by a cleaning blade 202*a* of the cleaning device 202 and accumulated. in the cleaning device 202.

Such an image forming apparatus has involved such problems that (1) the developer accumulated in the cleaning device must be disposed, and so maintenance is complicated, (2) pollution about the image forming apparatus and of environment is incurred by flying of the developer, (3) the photosensitive member is abraded or damaged by its contact with the cleaning blade, and so image quality is deteriorated as the number of printed sheets increases, (4) the developer ground by the contact with the cleaning blade adheres to the photosensitive. member to tend to cause toner filming,.and (5) the degree of freedom of design in the image forming apparatus is lowered by the provision of the cleaning device, thereby interfering with the miniaturization of the image forming apparatus.

In order to solve such problems as described above, there have therefore been proposed developing methods (cleaning systems concurrent with development) that a one-component developer is used to recover the developer remaining on a photosensitive member by a developing device at the same time-as development (Japanese Patent Application Laid-Open Nos. 203182/1987and 7972/1991). When such a cleaning system concurrent with development is adopted, there is no need to provide a cleaning device equipped with a cleaning blade. As described above, the surface of the photosensitive member is evenly and uniformly charged to a plus (+) or minus (−) charge. In the cleaning system concurrent with development, a developing roller carrying the developer charged to the same polarity as the charged polarity of the photosensitive member is arranged in opposition to the photosensitive member, and an exposed region on the photosensitive member, which has been charged, is developed with the developer, and at the same time the remaining developer adhered to a non-exposed region on the photosensitive member is removed by suction on the side of the developing roller to conduct cleaning.

FIG. 1 illustrates an exemplary image forming apparatus for carrying out such a developing system. The details of the image forming apparatus illustrated in FIG. 1 will be described subsequently. Here, the principle of the cleaning system concurrent with development is described with reference to FIG. 1 and FIG. 3. As illustrated in FIG. 3(A), the surface of a photosensitive member 1 is first evenly and uniformly charged to, for example, a plus charge by means of a charging device 3 (for example, charging roller). Image exposure is then conducted by a exposing device 4 to form an electrostatic latent image on the photosensitive member 1. As illustrated in FIG. 3(B), the charge vanishes at an exposed region 302 on the photosensitive member due to photoconductivity, and so the surface potential thereof is lowered. The plus (+) charge remains at a non-exposed region 301. As illustrated in FIG. 3(C), a thin layer 10*a* of a developer (toner) charged to a plus (+) charge is formed on the surface of a developing roller 8.

The surface potential of the non-exposed region 301 and the surface potential of the exposed region 302 on the photosensitive member 1 are regarded as Vo and Vq, respectively. The development bias voltage applied to the developing roller 8 is regarded as Vb, and the surface potential Ve of the developing roller 8 is regarded as being equal to the bias voltage Vb. The electrostatic latent image on the photosensitive member is subjected to reversal development with the one-component developer (toner) charged to the same polarity as the polarity (i.e., the polarity of the photosensitive member charged) of the charge of the non-exposed region.

In this reversal development system, the intensity of the respective surface potentials is controlled so as to satisfy the relationship of the following inequality (I):

$$|Vo|>|Ve|>|Vq| \quad \text{(I)}$$

However, Vo, Ve and Vq have the same polarity. In the exposed region 302 on the photosensitive member 1, force according to the potential difference |Ve−Vq| toward the direction of the photosensitive member acts on the developer 10*a* on the developing roller 8, and so the developer adheres to the exposed region 302, whereby development is conducted. Even when a part of the developer remains on the photosensitive member after the transferring step, and the remaining developer 10*b* adheres to a non-exposed region 301 in the nest exposing step, force according to the potential difference |Vo−Ve| toward the direction of the developing roller acts on the remaining developer 10*b* in a developing step, and the remaining developer 10*b* is recovered by its adhesion to the developing roller 8. As a result, the remaining developer is also cleaned off at the same time as the reversal development as illustrated in FIG. 3(D). According to this cleaning system concurrent with development, the conventional cleaning devise becomes unnecessary. Even when the charge polarities of the surface of the photosensitive member and the developer are changed to minus (−), the same result can be yielded.

In the developing method according to this cleaning system concurrent with development, a developer layer as thin as possible is formed with an even thickness on the developing roller 8 by a layer-thickness regulating blade 9 for toner. As the developer, a non-magnetic one-component developer comprising a binder resin and a colorant and containing no magnetic powder is preferably used because it has a high electric resistance.

In the cleaning system concurrent with development, however, it is difficult to satisfy both image density and cleaning ability at the same time. When a potential difference |Ve−Vq| is made great in order to achieve sufficient image density, a potential difference |Vo−Ve| required for recovery of the remaining developer is lowered, and so cleaning becomes insufficient, and ghost images are liable to occur. When a potential difference |Vo−Ve| is made great in order to improve the cleaning ability, a potential difference |Ve−Vq| required for development is lowered, and so satisfactory image density cannot be achieved. When the transferability of a developer image on the photosensitive member to a transfer medium is insufficient, and an amount of the remaining developer increases, it is necessary to control the respective surface potentials Vo, Ve and Vq and moreover control the layer thickness of a layer formed on the developing roller and a rotational ratio of the photosensitive roller to the developing roller for the purpose of satisfying both image density and cleaning ability to properly maintain the development amount of the developer, thereby lessening the amount of the remaining developer after transfer. However, the scopes of control conditions of the respective surface potentials, layer thickness of the developer and rotational ratio are limited, and so it has been difficult to properly control these conditions. In addition, the remaining developer is used repeatedly without discarding it in the cleaning system concurrent with development, and so the properties of the developer tend to be deteriorated as the number of printed sheets increases in continuous printing or repeated printing over a long period of time, and it has been difficult to maintain high image quality.

In order to solve such a problem, it has heretofore been proposed to use a non-magnetic one-component developer containing a spherical polymerized toner obtained by a suspension polymerization process (Japanese Patent Application Laid-Open No. 188637/1993). The use of this non-magnetic one-component developer has involved problem that the flowability of the developer itself is deteriorated as the number of printed sheets increases, and the resulting image tends to cause increase in fog and blur though satisfactory image properties can be achieved in an initial stage according to the cleaning system concurrent with development.

In order to improve continuous printing ability and the like, various improvements have been proposed as to toners according to the grinding process. The ground toners are developers produced by melting and mixing various components such as a colorant, a charge control agent and a parting agent in a thermoplastic resin into a composition, grinding the composition and classifying the ground product. It has been proposed to control classification conditions to provide a ground toner in which the volume average particle diameter is 7 to 12 μm, the proportion of particles having a particle diameter of at most 6 μm is at most 13% by number, the proportion of particles having a particle diameter of at least 16 μm is at most 2% by volume, and the standard deviation of particle diameter volume distribution is at most 2.7 (Japanese Patent Application Laid-Open No. 22138/1996). It is reported in this publication that when a non-magnetic one-component developer comprising the ground toner is used, image deterioration (increase of roughness and fog in images, etc.) is hard to occur even in continuous printing or long-term repeated printing.

Similarly, in Japanese Patent Application Laid-Open Nos. 3244/1966, 129437/1983, 877/1990 and 22138/1996, it is also shown that a ground toner of a one-component or two-component system, in which the particle diameter distribution and the content of fine or coarse particles have been controlled, is useful in continuous printing and long-term repeated printing.

However, the mere control of the particle diameter distribution and the content of fine or coarse particles in the ground toner has been insufficient for the maintenance of high image quality in continuous printing and long-term repeated printing. In addition, in the ground toner, the form of particles is indefinite, and a ratio (average value) of length to breadth is generally greater than 1.3. The transfer efficiency of such a ground toner is as low as 60 to 80%. Therefore, the use of such a ground toner as a developer for the cleaning system concurrent with development has involved a problem that the scopes of conditions for properly controlling the respective surface potentials Vo, Ve and Vq and moreover properly controlling the layer thickness of the developer formed on the developing roller and rotational ratio of the photosensitive member and the developing roller are limited.

The phenomenon that the flowability of a developer is lowered, or fog and blur increase in images is attributable to the cleaning system concurrent with development. In an image forming apparatus making use of this developing method, a developer remaining on a photosensitive member after a transferring step is recovered by a developing device because no conventional cleaning device is provided, and the developer is used repeatedly. As a result, contents of abnormal developers such as a developer deteriorated in flowability, a developer low in charging properties and a developer charged to an opposite polarity increases as the number of printed sheets increases. When development is conducted with such developers, fog and blur increase in the resulting image.

In order to prevent deterioration of image quality by long-term use, there has heretofore been proposed a non-magnetic one-component developer comprising a polymerized toner in which the average particle diameter is 1 to 12 μm, a proportion of particles having a particle diameter of at least 16 μm is at most 10% by weight, and a coefficient of variation defined as a proportion of a standard deviation of the toner to the average particle diameter is at most 20% (Japanese Patent No. 2751210). In order to provide a polymerized toner having such a sharp particle diameter distribution, however, a classifying step is generally required, and a yield is greatly lowered because coarse particles are removed. It is desirable from the viewpoint of yield of the polymerized toner that the coefficient of variation be higher than 20%, preferably about 23 to 35%. There is a demand for development of a polymerized toner that can be provided without lowering the yield of the polymerized toner and provide high-quality images when it is applied to the cleaning system concurrent with development.

DISCLOSURE OF THE INVENTION

It is an object of the present invention to provide a non-magnetic one-component developer suitable for use in the cleaning system concurrent with development.

More specifically, the object of the present invention is to provide a non-magnetic one-component developer which does not cause lowering of flowability and image quality even in continuous printing or long-term repeated printing when it is applied to a developing method according to the cleaning system concurrent with development.

Another object of the present invention is to provide a developing method which is a developing method according to a cleaning system concurrent with development and does not cause fog and blur in the resulting image by continuous printing or long-term repeated printing.

The present inventors have carried out an extensive investigation with a view toward overcoming the above-described problems involved in the prior art. As a result, the present inventors have conceived a non-magnetic one-component developer comprising a substantially spherical polymerized toner the average particle diameter, particle diameter distribution, form, etc. of which have been controlled within respective specific selected ranges. The non-magnetic one-component developer according to the present invention is suitable for use as a developer for the cleaning system concurrent with development and does not cause lowering of flowability and image quality even in continuous printing or long-term repeated printing. The present invention has been led to completion on the basis of these findings.

According to the present invention, there is thus provided a non-magnetic one-component developer comprising a substantially spherical polymerized toner which contains at least a binder resin and a colorant and has the following features:

(a) the volume average particle diameter being 5 to 10 μm (b) the proportion of particles having a particle diameter of at most 5 μm being at most 25% by number;

(c) the proportion of particles having a particle diameter of at least 16 μm being at most 2% by volume;

(d) the standard deviation of the number particle diameter distribution being at most 1.8; and (e) the spheroidicity represented by a ratio (dl/ds) of a length (dl) to a breadth (ds) in a particle being 1.0 to 1.3.

The non-magnetic one-component developer according to the present invention is suitable for use as a developer for the cleaning system concurrent with development. The polymerized toner is preferably that obtained by subjecting a monomer composition containing at least a polymerizable monomer and a colorant to suspension polymerization. The polymerized toner particularly. preferably has a core-shell structure. It is preferable that a charge control resin containing a polar group and soluble in the polymerizable monomer be used as a charge control agent.

According to the present invention, there is also provided a developing method comprising arranging a developing roller carrying a developer charged to the same polarity as the charged polarity of the charged surface of a photosensitive member in contact with the photosensitive member, exposing the photosensitive member, and then developing an exposed region on the photosensitive member with the developer, and at the same time removing a remaining developer adhered to a non-exposed region on the photosensitive member by suction on the side of the developing roller to conduct cleaning, wherein the developer is a non-magnetic one-component developer comprising a substantially spherical polymerized toner which contains at least a binder resin and a colorant and has the following features:

(a) the volume average particle diameter being 5 to 10 μm;

(b) the proportion of particles having a particle diameter of at most 5 μm being at most 25% by number;

(c) the proportion of particles having a particle diameter of at least 16 μm being at most 2% by volume;

(d) the standard deviation of the number particle diameter distribution being at most 1.8; and (e) the spheroidicity represented by a ratio (dl/ds) of a length (dl) to a breadth (ds) in a particle being 1.0 to 1.3.

It is preferable that the photosensitive member and the developing roller be rotated in the same direction as each other at the contact portion thereof, and the rotational ratio between both can be controlled.

BEST MODE FOR CARRYING OUT THE INVENTION

Physical Properties of Polymerized Toner

Figure 1:
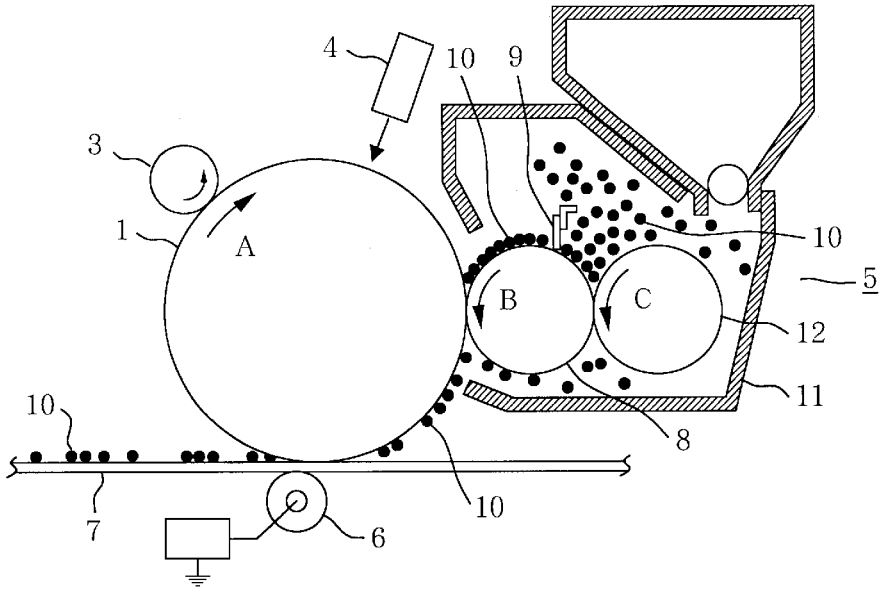
FIG. 1 is a schematic cross-sectional view illustrating an example of an image forming apparatus used in the present invention.
Figure 2:
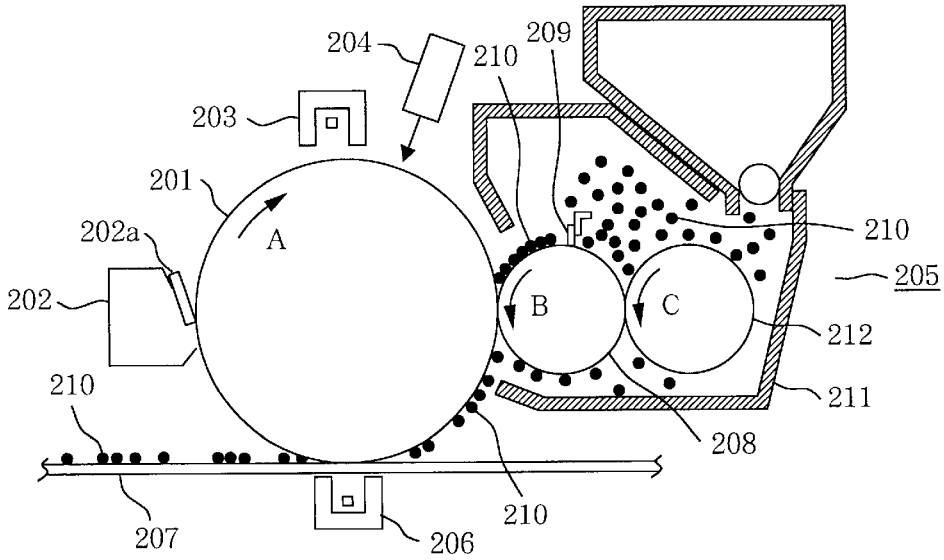
FIG. 2 is a schematic cross-sectional view illustrating an example of the conventional image forming apparatus.

The non-magnetic one-component developer according to the present invention comprises a polymerized toner as a main component and generally contains the polymerized toner and external additives such as a flowability-imparting agent and an abrasive. The physical properties of the polymerized toner used in the present invention and measuring methods thereof will be described.

The volume average particle diameter of the polymerized toner according to the present invention is 5 to 10 $\mu$m, preferably 6 to 9 $\mu$m. If the volume average particle diameter of the polymerized toner is smaller than 5 $\mu$m, the flowability of the resulting developer is deteriorated as the number of printed sheets increases, and fog increases. If the volume average particle diameter of the polymerized toner is greater than 10 $\mu$m, the resolution of the resulting developer is deteriorated. The volume average particle diameter of the polymerized toner is a value measured by means of a Multisizer (manufactured by Coulter Co.).

The proportion of particles having a particle diameter of at most 5 $\mu$m in the polymerized toner according to the present invention is at most 25% by number, preferably 15 to 25% by number. If the proportion of particles having a particle diameter of at most 5 $\mu$m in the polymerized toner is higher than 25% by number, the flowability of the resulting developer is deteriorated as the number of printed sheets increases, and images formed tend to increase fog and cause blur.

The proportion of particles having a particle diameter of at least 16 $\mu$m in the polymerized toner according to the present invention is at most 2% by volume, preferably at most 1.5% by volume. If the proportion of particles having a particle diameter of at least 16 $\mu$m in the polymerized toner exceeds 2% by volume, the resulting developer tends to deteriorate resolution and cause white stripes.

The standard deviation of the number particle diameter distribution in the polymerized toner according to the present invention is at most 1.8, preferably 1.5 to 1.8. If the standard deviation of the number particle diameter distribution in the polymerized toner is greater than 1.8, the flowability of the resulting developer is deteriorated as the number of printed sheets increases, and images formed tend to increase fog and cause blur.

The particle diameter, % by number, % by volume and standard deviation of the number particle diameter distribution are values measured by means of a Multisizer (manufactured by Coulter Co.).

The ratio (dl/ds) of a length (dl) to a breadth (ds) in the polymerized toner according to the present invention being 1 to 1.3, preferably 1 to 1.2. This ratio represents spheroidicity of the toner, and a polymerized toner falling within the above range is substantially spherical. When the non-magnetic one-component developer comprising the substantially spherical polymerized toner is used, the transfer efficiency to a transfer medium is enhanced to at least 90%. Therefore, when the respective surface potentials Vo, Ve and Vq, the thickness of a toner layer formed on a developing roller and a rotational ratio of a photosensitive roller to the developing roller are controlled for the purpose of satisfying both image density and cleaning ability in the cleaning-system concurrent with development, the respective optimal conditions can be widened. The ratio of the length to the breadth in the polymerized toner is an average value of 100 toner particles determined by taking a photograph of the polymerized toner through a transmission electron microscope, and reading the photograph in a nexus 9000 type image processing apparatus to divide the length of the toner by the breadth thereof, thereby finding the value (dl/ds).

In order to produce the polymerized toner, additive components such as colorant and a charge control agent are uniformly dispersed in a polymerizable monomer to prepare a monomer composition, the monomer composition is poured into an aqueous suspension medium to stir the resultant dispersion, thereby forming fine droplets of the monomer composition, and the monomer composition is then subjected to suspension polymerization. It is desirable that the additive components be made as small as possible to uniformly disperse them in the polymerizable monomer. However, in many cases, they may be made small to the size of from several microns to 1 to 3 microns with difficulty. Therefore, there is a high possibility that a necessary amount of the additive components may not be contained with them uniformly dispersed as the particle diameter of the resulting polymerized toner is smaller. Accordingly, it is preferable to strictly control the particle diameter of the toner so as to make the proportion of small diameter particles in the polymerized toner lower. The proportions of small diameter particles and great diameter particle are preferably controlled by polymerization conditions. However, the polymerized toner particles obtained by the polymerization may be classified as needed.

The additive components such as the charge control agent are preferably selected from those soluble in the polymerizable monomer from the viewpoint of uniform dispersibility of the additive components. More specifically, for example, a charge control resin having a polar group soluble in styrene used as the polymerizable monomer is preferred as the charge control agent. As the parting agent, a polyvalent polyester compound is preferred because it is uniformly dispersed in the polymerizable monomer, and a charge level distribution becomes uniform.

Raw Materials of Polymerized Toner

The polymerized toner according to the present invention contains at least a binder resin, a colorant and a charge control agent. The binder resin is formed by subjecting a polymerizable monomer to suspension polymerization.

(1) Polymerizable Monomer:

As the polymerizable monomer used for providing the polymerized toner according to the present invention, is generally used a monovinyl monomer. As specific examples thereof, may be mentioned styrenic monomers such as styrene, vinyltoluene and $\alpha$-methylstyrene; acrylic acid and methacrylic acid; (meth)acrylic acid derivatives such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Of these monovinyl monomers, the styrenic monomers, or the acrylic acid or methacrylic acid derivatives are preferably used.

(2) Polymerization Initiator:

The polymerizable monomer is generally polymerized by using a polymerization initiator. As examples of the polymerization initiator, may be mentioned azo compounds such as 4,4'-azobis(4-cyanovaleric acid), 2,2'-azobis(2-amidinopropane)bihydrochloride, 2,2-azobis-2-methyl-N-1,1-bis(hydroxymethyl)-2-hydroxyethylpropionamide, 2,2'1-azobis(2,4-dimethylvaleronitrile), 2,2'-azobis-isobutyronitrile and 1,1'-azobis(1-cyclohexane-carbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate.

Among these, oil-soluble radical initiators selected from among organic peroxides whose decomposition temperature giving a half-life period of 10 hours are 60 to 80° C., preferably 65 to 80° C. and whose molecular weights are 250 or lower are preferred, with t-butyl peroxy-2-ethylhexanoate being particularly preferred because the resulting polymerized toner barely causes environmental destruction by volatile components such as odor.

The amount of the polymerization initiator used is generally 0.01 to 20% by weight based on the polymerizable monomer. If the amount of the polymerization initiator used is less than 0.01% by weight, the rate of polymerization becomes slow. Any too high proportion is. not economical. If the amount exceeds 20% by-weight, the molecular weight of the resulting polymer becomes low. It is hence not preferable to use the initiator in such a little or great amount.

(3) Molecular Weight Modifier:

In the present invention, as needed, a molecular weight modifier may be used upon production of the polymerized toner. As examples of the molecular weight modifier, may be mentioned mercaptans such as t-dodecyl-mercaptan, n-dodecylmercaptan and n-octylmercaptan; and halogenated hydrocarbons such as carbon tetrachloride and carbon tetrabromide.

The molecular weight modifier may be added before the initiation of the polymerization or in the course of the polymerization to contain it in the polymerizable monomer composition. The molecular weight modifier is used in a proportion of generally 0.01 to 10 parts by weight, preferably 0.1 to 5 parts by weight per 100 part by weight of the polymerizable monomer.

(4) Crosslinkable Monomer:

The use of a crosslinkable monomer upon the production of the polymerized toner is useful for prevention of hot offset. The crosslinkable monomer is a monomer having two or more polymerizable carbon-carbon unsaturated double bonds in its molecule. As specific examples thereof, may be mentioned aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof.

The crosslinkable monomer is used in a proportion of generally 0.05 to 5 parts by weight, preferably 0.1 to 2 parts by weight per 100 parts by weight of an uncrosslinkable polymerizable monomer such as a monovinyl monomer.

(5) Macromonomer:

In the present invention, a macromonomer may be used together with the polymerizable monomer for the purpose of enhancing the shelf stability (blocking resistance) of the resulting polymerized toner and improving a balance between offset resistance and low-temperature fixing ability of the polymerized toner. The macromonomer is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of about 1,000 to 30,000. If a macromonomer having a too low number average molecular weight is used, the surface part of the resulting polymerized toner becomes soft, and the shelf stability thereof is deteriorated. If a macromonomer having a too high number average molecular weight is used on the other hand, the melt properties of the macromonomer itself becomes poor, resulting in a polymerized toner deteriorated in fixing ability.

The macromonomer preferably has a glass transition temperature (Tg) higher than that of a polymer obtained by polymerizing the polymerizable monomer (monovinyl monomer). Tg of the macromonomer is a value measured by means of an ordinary measuring device such as a differential scanning calorimeter (DSC).

As specific examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7 and having a polymerizable double bond at the polymer terminal and optional repeating structural units.

Among these macromonomers, hydrophilic macromonomers, in particular, polymers obtained by polymerizing styrene and methacrylic esters either singly or in combination thereof are preferred.

The amount of the macromonomer is generally 0.01 to 1 part by weight, preferably 0.03 to 0.8 parts by weight per 100 parts by weight of the polymerizable monomer. If the amount of the macromonomer used is too little, the effect of improving the shelf stability and offset resistance of the resulting toner becomes little. If the amount of the macromonomer used is too great, the fixing ability of the resulting polymerized toner is deteriorated.

(6) Colorant:

In the present invention, a colorant is used for the provision of a polymerized toner. When the colorant is carbon black of a black pigment, that having a primary particle diameter of 20 to 40 nm. If the primary particle diameter of carbon black is too smaller, the dispersibility of the carbon black is deteriorated, resulting in a polymerized toner providing greatly fogged images. If the primary particle diameter of carbon black is too great on the other hand, the content of polycyclic aromatic hydrocarbons as impurities in the resulting toner becomes high, and a problem may arise from the viewpoint of safety.

As black pigments used in the present invention, may be mentioned magnetic particles such as triiron tetroxide, manganese iron oxide, zinc iron oxide and nickel iron oxide in addition to carbon black. No particular limitation is imposed on colorants for color toners, and various kinds of yellow colorants, magenta colorants and cyan colorants may be used. Specific examples thereof include Naphthol Yellow S, Hansa Yellow GI C.I. Pigment Yellow, C.I. Vat Yellow, eosine lake, C.I. Pigment Red, C.I. Pigment Violet, C.I. Vat Red, Phthalocyanine Blue, C.I. Pigment Blue, C.I. Vat Blue and C.I. Acid Blue.

The colorant is used in a proportion of generally 0.1 to 20 parts by weight, preferably 1 to 10 parts by weight per 100 parts by weight of the polymerizable monomer.

(7) Lubricant and Dispersing Agent:

A fatty acid such as oleic acid or stearic acid; a fatty acid metal salt with a metal such as Na, K, Ca, Mg or Zn; a dispersion aid such as a silane or titanium coupling agent; and/or the like may also be used with a view toward uniformly dispersing the colorant in the resulting polymerized toner. Such a lubricant or dispersing agent is generally used in a proportion of about 1/1,000 to 1/1 based on the weight of the colorant.

(8) Charge Control Agent:

Various kinds of charge control agents are desirably added for the purpose of controlling the charging properties of the resulting polymerized toner.

As the charge control agents, may be used generally used charge control agents having positively charging-ability or negatively charging ability. Specific examples thereof include metal complexes of organic compounds having a carboxyl group or a nitrogen-containing group, metallized dyes and nigrosine. More specifically, may be mentioned Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-84 (product of Orient Chemical Industries Ltd.), Bontron N-01 (product of Orient Chemical Industries Ltd.), Bontron EX (nigrosine; product of Orient Chemical Industries Ltd.), Copy Blue-PR (product of Hoechst AG), and charge control resins such as quaternary ammonium salt-containing resins and sulfonic group-containing resins.

Of these, charge control resins having a polar group and soluble in a polymerizable monomer such as styrene, such as quaternary ammonium salt-containing resins and sulfonic group-containing resins are preferred. As the quaternary ammonium salt-containing resins, are preferred, for example, copolymers of a vinyl aromatic hydrocarbon monomer, a (meth)acrylate monomer and dimethylaminoethyl methacrylate benzyl chloride. As the sulfonic group-containing resins, are preferred copolymers of a vinyl monomer such as a vinyl aromatic hydrocarbon monomer or a (meth)acrylate monomer and a (meth)acrylamide monomer containing an $SO_3X$ group (X=H or alkali metal). The weight average molecular weight (Mw) of the charge control resin is preferably 2,000 to 40,000 in terms of polystyrene as measured by gel permeation chromatography (GPC) using tetrahydrofuran.

The amount of the charge control agent used is generally 0.01 to 10 parts by weight, preferably 0.03 to 5 parts by weight per 100 parts by weight of the polymerizable monomer.

(9) Parting Agent:

A parting agent may be used for the purpose of improving the parting ability of the resulting polymerized toner. As examples of the parting agent, may be mentioned polyfunctional ester compounds such as pentaerythritol tetramyristate and pentaerythritol tetrastearate; low molecular weight polyolefins such as low molecular weight polyethylene, low molecular weight polypropylene and low molecular weight polybutylene; paraffin waxes; and synthetic waxes such as Fischer-Tropsch wax.

Of these, those having a melting point of 60 to 110° C. are preferred, with pentaerythritol tetramyristate being particularly preferred because it is soluble in the polymerizable monomer. The parting agent is used in a proportion of generally 0.1 to 30 parts by weight, preferably 0.5 to 20 parts by weight per 100 parts by weight of the polymerizable monomer.

Production Process of Polymerized Toner:

The monomer composition containing the polymerizable monomer, colorant and optional various additives is subjected to polymerization in accordance with a suspension polymerization process, emulsion polymerization process, dispersion polymerization process or the like to form a polymerized toner. As the polymerization process, is particularly preferred the suspension polymerization process.

1. Dispersion stabilizer-containing aqueous dispersion medium:

The suspension polymerization is generally conducted in an aqueous dispersion medium containing a dispersion stabilizer. As the dispersion stabilizer, is preferred colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly watet-soluble metal hydroxides are preferred because the particle diameter distribution of the resulting polymerized toner (colored polymer particles) can be narrowed, and the brightness or sharpness of an image formed from such a polymerized toner is enhanced. After completion of the polymerization reaction, the hardly water-soluble metal hydroxide remaining on the surfaces of the colored polymer particles may be removed by acid washing and water washing generally conducted. Thereafter, the washed polymer particles are dehydrated and dried, whereby the polymerized toner can be obtained.

In general, the colloid of the hardly water-soluble metal hydroxide can be suitably prepared by preparing an aqueous solution of a water-soluble polyvalent metallic compound and adding an alkali metal hydroxide in such a manner that the pH thereof is kept to 7 or higher, thereby obtaining an aqueous dispersion medium containing colloid of the hardly water-soluble metal hydroxide. The adjustment of the pH is generally-conducted with an aqueous solution of an alkali metal hydroxide. Examples of the water-soluble polyvalent metallic compound include the hydrochlorides, carbonates, sulfates, nitrates and acetates of polyvalent metals such as magnesium, calcium and aluminum. Examples of the alkali metal hydroxide include sodium hydroxide and potassium hydroxide. The alkali metal hydroxide is preferably used in the form of an aqueous solution.

The colloid of the hardly water-soluble metallic compound used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization reaction system is broken, and the resulting polymerized toner also shows a tendency to deteriorate its shelf stability.

In the present invention, other dispersion stabilizers such as a water-soluble polymer may be used as needed. As examples of the water-soluble polymer, may be mentioned polyvinyl alcohol, methyl cellulose and gelatin. Any surfactant is not necessarily used. However, a surfactant may be used for the purpose of stably conducting the polymerization so far as the environmental dependence of the charge properties of the resulting polymerized toner does not become high.

The dispersion stabilizer is used in a proportion of generally 0.1 to 20 parts by weight per 100 parts by weight of the polymerizable monomer. If the proportion of the dispersion stabilizer used is too low, it is difficult to achieve sufficient dispersion stability of droplets of the monomer composition, so that aggregates of polymer particles are liable to form. If the proportion of the dispersion stabilizer used is too high on the other hand, the viscosity of the aqueous dispersion medium is increased to widen the particle diameter distribution of the resulting polymerized toner. Therefore, the yield of the polymer formed is lowered.

2. Droplet-forming Step:

In order to produce a polymerized toner by the suspension polymerization process, fine droplets of a monomer composition containing at least a polymerizable monomer and a colorant are formed in an aqueous dispersion medium containing a dispersion stabilizer, the monomer composition is then subjected to suspension polymerization in the presence of a polymerization initiator to produce colored polymer particles (polymerized toner).

More specifically, a polymerizable monomer and a colorant, and optionally, various kinds of additive components such as a crosslinkable monomer, a macromonomer, a dispersion aid, a charge control agent, a molecular weight modifier and a parting agent are mixed with one another to uniformly disperse them by means of a ball mill or the like, thereby preparing an intimate liquid mixture (monomer composition). This monomer composition is then poured into an aqueous medium containing a dispersion stabilizer to disperse it in the aqueous medium by means of a mixer having high shearing force, thereby forming fine droplets.

The polymerization initiator is preferably added to the aqueous dispersion medium before the formation of the fine droplets of the monomer composition is completed. The time when the polymerization initiator is added is a point of time the volume average droplet diameter of primary droplets formed by the stirring of the monomer composition by means of the mixer having high shearing force has amounted to generally 50 to 1,000 $\mu$m, preferably 100 to 500 $\mu$m. The temperature of the aqueous dispersion medium from the addition of the polymerization initiator to the subsequent droplet-forming step is desirably regulated within a range of generally about 10 to 40° C., preferably about 20 to 30° C. The polymerization initiator added is united with the droplets of the monomer composition in the droplet-forming step to migrate into fine droplets finally formed. When the polymerization initiator is incorporated into the polymerizable monomer composition in the preparation step of the monomer composition, premature polymerization tends to occur in the droplet-forming step.

No particular limitation is imposed on the method for forming the droplets. However, a method in which the aqueous dispersion containing the monomer composition is passed through between a rotor which rotates on its axis at high speed, and a stator surrounding it and having small openings or comb-like teeth is preferred.

In the droplet-forming step, the above primary droplets are dispersed to secondary droplets having a droplet diameter and a droplet diameter distribution corresponding to the intended particle diameter and particle diameter distribution of the resulting polymerized toner to form fine droplets. The volume average droplet diameter of the fine droplets of the monomer composition is generally 4 to 9 $\mu$m, preferably 5 to 8 $\mu$m. If the droplet diameter of the droplets is too great, the particle diameter of the resulting polymerized toner become too great, so that the resolution of images formed from such a toner is deteriorated. The ratio of the volume average droplet diameter to the number average droplet diameter of the droplets is generally 1.0 to 3.0, preferably 1.0 to 2.0. If the droplet diameter distribution of the droplets is too wide, the fixing temperature of the resulting polymerized toner varies, so that inconveniences such as fogging and toner filming tend to occur. The droplets of the monomer composition preferably have a droplet diameter distribution that at least 30% by volume, preferably at least 60% by volume of the droplets are present within a range of (the volume average droplet diameter±1 $\mu$m).

3. Polymerization Step:

The concentration of the monomer composition in the aqueous dispersion medium is generally 5 to 40% by weight, preferably 8 to 30% by weight. After droplet-forming step, the droplets are subjected to suspension polymerization. The-suspension polymerization may also be conducted in the container used in the drop-forming step. Since such a method tends to scale and form coarse polymer particles in plenty, it preferable that the suspension obtained in the droplet-forming step be transferred to another reactor for polymerization to conduct suspension polymerization.

The suspension polymerization is generally carried out by charging the suspension obtained in the droplet-forming step into a reactor equipped with a stirrer while controlling the reaction temperature. The reaction temperature is generally 5 to 120° C., preferably 35 to 95° C. If the reaction temperature is too low, it is necessary to use a polymerization initiator high in catalytic activity, and so it is difficult to control the polymerization reaction. If the reaction temperature is too high, the dispersion stability of the droplets are lowered to disorder the particle diameter distribution or form scale on the wall of the reactor.

It is preferable that colored polymer particles (polymerized toner), in which the volume average particle diameter is 5 to 10 $\mu$m, preferably 6 to 9 $\mu$m, the proportion of particles having a particle diameter of at most 5 $\mu$m is at most 25% by number, the proportion of particles having a particle diameter of at least 16 $\mu$m is at most 2% by volume, preferably at most 1.8% by volume, and the standard deviation of the number particle diameter distribution is at most 1.8, preferably at most 1.7, be formed by the suspension polymerization. When no polymerized toner that the volume average particle diameter, particle diameter distribution and the like fall within the respective desired ranges cannot be provided by the suspension polymerization, classification may be conducted.

4. Polymerized Toner of Core·Shell Structure:

The polymerized toner may be provided as a polymerized toner having a core-shell structure for the purpose of improving the low-temperature fixing ability, offset resistance, shelf stability and the like of the polymerized toner. More specifically, colored polymer particles are formed as core particles, and a polymer layer is formed so as to cover each of the core particles. Tg of a polymer forming the polymer layer (shell) is made higher than that of a polymer making up the colored polymer particles (core particles), whereby blocking of the polymerized toner particles during storage and offset thereof can be prevented. On the other hand, Tg of the polymer making up the colored polymer particles (core particles) is made lower, thereby the fixing ability of the toner can be improved.

As the polymerizable monomer for shell (monomer for shell), which forms the polymer layer, are preferred monomers capable of forming a polymer having a Tg higher than 80° C., for example, styrene and methyl methacrylate. These monomers may be used either singly or in combination of two or more monomers thereof. When the glass transition a temperature of the polymer making up the colored polymer particles which will become core particles is far lower than 60° C., a monomer which forms a polymer having a Tg lower than 80° C. may be used.

However, Tg of the polymer formed from the monomer for shell must be preset so as to be higher than Tg of the colored polymer particles forming the core particles. In order to improve the shelf stability of the resulting polymerized toner, Tg of the polymer formed from the monomer for shell is generally higher than 50° C., but not higher than 120° C., preferably higher than 60° C., but not higher than 110° C., more preferably at least 80° C., but not higher than 105° C. A difference in Tg between the polymer forming the core and the polymer formed from the monomer for shell is generally at least 10° C., preferably at least 20° C., more preferably at least 30° C.

The monomer for shell is polymerized in the presence of the core particles (colored polymer particles). In this case, it is preferable that the monomer for shell be added to the reaction system in the form of droplets smaller than the number average particle diameter of the core particles. If the droplet diameter of the droplets of the monomer for shell is too great, the polymer layer (shell) is hard to be uniformly formed around each of the core particles, and so the shelf stability of the resulting polymerized toner is deteriorated.

In order to form the monomer for shell into fine droplets, a mixture of the monomer for shell and the aqueous dispersion medium is subjected to a finely dispersing treatment by means of, for example, an ultrasonic emulsifier. It is preferred that the aqueous dispersion thus obtained be added to the reaction system in which the core particles are present.

When the monomer for shell is a monomer having a high solubility in water, i.e., a monomer having a solubility of at least 0.1 wt. % in water at 20° C., it becomes liable to quickly migrate to the surfaces of the core particles, so that a polymerized toner of core·shell structure having good shelf stability is easy to obtain. Examples of the monomer having a solubility of at least 0.1 wt. % in water at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

On the other hand, when the monomer for shell is a monomer having a solubility lower than 0.1 wt. % in water at 20° C., its migration to the surfaces of the core particles becomes slow. Therefore, it is preferable to polymerize such a monomer in the form of fine droplets. Even when a monomer for shell having a solubility lower than 0.1 wt. % in water at 20° C. is used, the monomer for shell becomes easy to quickly migrate to the surfaces of the core particles when an organic solvent having a solubility of at least 5 wt. % in water at 20° C. is added to the reaction system, so that a polymerized-toner of core-shell structure having good shelf stability is easy to obtain. Examples of the polymerizable monomer for shell having a solubility lower than 0.1 wt. % in water at 20° C. include styrene, butyl acrylate, 2-ethylhexyl acrylate, ethylene and propylene.

As examples of the organic solvent preferably used in the case where the monomer for shell having a solubility lower than 0.1 wt. % in water at 20° C. is used, may be mentioned lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and amides such as dimethylformamide. The organic solvent is added in such an amount that the solubility of the monomer for shell in the dispersion medium (containing water and the organic solvent in combination) is at least 0.1% by weight. The specific amount of the organic solvent added varies according to the kind of the organic solvent, and the kind and amount of the monomer for shell. However, it is generally 0.1 to 50 parts by weight, preferably 0.1 to 40 parts by weight, more preferably 0.1 to 30 parts by weight per 100 parts by weight of the aqueous dispersion medium. No particular limitation is imposed on the order of addition of the organic solvent and the monomer for shell to the reaction system. In order to facilitate the migration of the monomer for shell to the core particles to make easy to obtain polymer particles having good shelf stability, however, it is preferable to first add the organic solvent to the reaction system and then add the monomer for shell.

When a monomer having a solubility lower than 0.1 wt. % in water at 20° C. and a monomer having a solubility of at least 0.1 wt. % in water at 20° C. are used in combination, it is preferable to first add the monomer having a solubility of at least 0.1 wt. % in water at 20° C. to polymerize it, then add the organic solvent, and further add the monomer having a solubility lower than 0.1 wt. % in water at 20° C. to polymerize it.

In the present invention, it is preferable that the monomer for shell be mixed with a charge control agent, and the mixture is then added to the reaction system from the viewpoint of improving the charging properties of the resulting polymerized toner. As the charge control agent, there may be used such agents as described above. The charge control agent is used in a proportion of generally 0.01 to 10 parts by weight, preferably 0.1 to 5 parts by weight per 100 parts by weight of the monomer for shell.

As examples of a specific process for polymerizing the monomer for shell in the presence of the core particles, may be mentioned a process in which the monomer for shell is added to the polymerization reaction system in which the core particles (colored polymer particles) have been synthesized, thereby continuously conducting polymerization, and a process in which the core particles obtained in a separate reaction system are charged into a reactor, and the monomer for-shell is added thereto, thereby conducting polymerization. The monomer for shell may be added to the reaction system in one lot, or continuously or intermittently by means of a pump such as a plunger pump.

In order to make easy to obtain polymer particles of core-shell structure, it is preferable to add a water-soluble radical initiator at the time the monomer for shell is added. It is considered that when the water-soluble radical initiator is added upon the addition of the polymerizable monomer for shell, the water-soluble initiator enters in the vicinity of each outer surface of the core particles to which the monomer for shell has migrated, so that a polymer layer (shell) is easy to be formed on the core particle surface.

As examples of the water-soluble radical initiator, may be mentioned persulfates such as potassium persulfate and ammonium persulfate; azo initiators such as 4,4'-azo-bis(4-cyanovaleric acid), 2,2'-azobis(2-amidinopropane) bihydrochloride, 2,2'-azobis-2-methyl-N-1,1-bis-(hydroxymethyl)-2-hydroxyethylpropionamide and 2,2'-azobis-[2-methyl-N-(2-hydroxyethyl)-propionamide; and combinations of an oil-soluble initiator such as cumene peroxide with a redox catalyst. The amount of the water-soluble radical initiator used is generally 0.01 to 20 parts by weight per 100 parts by weight of the monomer for shell.

In the polymerized toner having the core·shell structure, a weight ratio of the polymerizable monomer for core (monomer for forming colored polymer particles which will become core particles) to the monomer for shell is generally 80/20 to 99.9/0.1, preferably 80/20 to 99.7/0.3, more preferably 90/10 to 99.5/0.5. When the weight ratio falls within the above range, the shelf stability of the resulting polymerized toner becomes extremely good. The average thickness of the shell is generally 0.001 to 1.0 μm, preferably 0.003 to 0.5 μm, more preferably 0.005 to 0.2 μm. If the thickness is too great, the fixing ability of the toner is deteriorated. If the thickness of the shell is too small, the shelf stability of the toner is deteriorated. In the polymerized toner having the core·shell structure according to the present invention, there is no need to cover the whole core part with the shell.

The particle diameters of the core particles and the thickness of the shell can be determined by directly measuring the size and shell thickness of each of particles selected at random from electron photomicrographs thereof when they can be observed through an electron microscope. If it is difficult to clearly distinguish the core from the shell by observation through the electron microscope, the average thickness of the shell can be calculated out from the particle diameters of the core particles directly measured and the amount of the monomer used for forming the shell.

The polymerized toner having the core·shell structure is also required to have the features that the volume average particle diameter is 5 to 10 μm, the proportion of particles having a particle diameter of at most 5 μm is at most 25% by number, the proportion of particles having a particle diameter of at least 16 μm is at most 2% by volume, and the standard deviation of the number particle diameter distribution is at most 1.8.

5. Non-magnetic One-component Developer:

The non-magnetic one-component developer comprising the polymerized toner according to the present invention is prepared by adding external additives such as a flowability-imparting agent and an abrasive to the polymerized toner obtained above. The external additives include inorganic particles and organic resin particles.

Examples of the inorganic particles include particles of silicon dioxide, aluminum oxide, titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, and core·shell type particles in which the core is composed of a methacrylic ester polymer, and the shell is composed of a styrene polymer. Of these, the particles of the inorganic oxides, particularly, silicon dioxide particles are preferred. The surfaces of these-particles can be subjected to a hydrophobicity-imparting treatment, and silicon dioxide particles subjected to the hydrophobicity-imparting treatment are particularly preferred. No particular limitation is imposed on the amount of the external additives used. However, it is generally about 0.1 to 6 parts by weight per 100 parts by weight of the toner particles.

Two or more of the external additives may be used in combination. When the external additives are used in combination, it is preferable to use two or more kinds of inorganic oxide particles or organic resin particles different in average particle diameter from each other in combination.

More preferably, it is preferable to use particles (preferably, inorganic oxide particles) having an average particle diameter of 5 to 20 nm, preferably 7 to 18 nm and particles (preferably, inorganic oxide particles) having an average particle diameter of greater than 20 nm, but not greater than 2 μm, preferably 30 nm to 1 μm in combination. The average particle diameter of the external additive particles means an average value of particle diameters of 100 particles selected and measured at random from among particles observed through a transmission electron microscope, i.e., a number average particle diameter.

The amounts of the above two kinds of external additives (particles) used are generally 0.1 to 3 parts by weight, preferably 0.2 to 2 parts by weight per 100 parts by weight of the toner particles for the particles having an average particle diameter of 5 to 20 nm and generally 0.1 to 3 parts by weight, preferably 0.2 to 2 parts by weight for the particles having an average particle diameter of greater than 20 nm, but not greater than 2 μm. A weight ratio of the particles having an average particle diameter of 5 to 20 nm to the particles having an average particle diameter of greater than 20 nm, but not greater than 2 μm is within a range of generally 1:5 to 5:1, preferably 3:10 to 10:3.

The adhesion of the external additives to the toner particles is generally conducted by charging them into a mixer such as a Henschel mixer to mix them under stirring.

Image Forming Apparatus and Developing Method:

The non-magnetic one-component developer comprising the polymerized toner according to the present invention may be suitably used in the cleaning system concurrent with development. An image forming apparatus, by which development can be conducted in accordance with the cleaning system concurrent with development, comprises a photosensitive member, a charging means for charging the surface of the photosensitive member, an exposing means for forming an electrostatic latent image on the surface of the photosensitive member, a developing means for receiving a polymerized toner and supplying the polymerized toner to develop the electrostatic latent image on the surface of the photosensitive member, thereby forming a developer image, a transferring means for transferring the developer image from the surface of the photosensitive member to a transfer medium, and a fixing means for fixing the developer image to the transfer medium.

A specific example of such an image forming apparatus is illustrated in FIG. 1. As illustrated in FIG. 1, in the image forming apparatus, a photosensitive drum 1 as the photosensitive member is installed rotatably in the direction of an arrow A. The photosensitive drum 1 has a structure that a photoconductive layer is provided around a peripheral surface of an electroconductive support drum. The photoconductive layer is composed of, for example, an organic photosensitive member, selenium photosensitive member, zinc oxide photosensitive member or amorphous silicon photosensitive member.

Around the photosensitive drum 1, a charging roller 3 as a charging means, a laser beam irradiating device 4 as a latent image forming means, a developing roller 8 as a developing means and a transfer roller 6 as a transfer means are arranged along the circumferential direction of the drum.

The charging roller 3 bears an action that the surface of the photosensitive drum 1 is evenly and uniformly charged to a plus or minus charge. Voltage is applied to the charging roller 3, and the charging roller 3 is brought into contact with the surface of the photosensitive drum 1, thereby charging the surface of the photosensitive drum 1. The charging roller 3 may be replaced by a charging means according to corona discharge.

The laser beam irradiating device 4 bears an action that light corresponding to image signals is irradiated on the surface of the photosensitive drum 1 to expose the surface of the photosensitive drum 1 evenly and uniformly charged to the light on the predetermined pattern, thereby forming an electrostatic latent image on the exposed portion of the drum (in the case of reversal development). In the case of normal development, an electrostatic latent image is formed on the unexposed portion of the drum. An example of other latent image forming means includes that composed of an LED array and an-optical system.

The developing roller 8 bears an action that a developer (toner) is applied to the electrostatic latent image formed on the surface of the photosensitive drum 1, and so the toner is applied only to a light-exposed portion in reversal development. In normal development, on the other hand, bias voltage is applied between the developing roller 8 and the photosensitive drum 1 in such a manner that the toner is applied only to a light-unexposed portion.

The developing device 5 has a structure that a developing roller 8 and a developer feed roller 12 are provided within a casing 11 in which a developer 10 is contained. The developing roller 8 is arranged in such a manner that a part thereof comes into contact with the photosensitive drum 1, and is rotated in a rotating direction B opposite to the rotating direction A of the photosensitive drum 1. Accordingly, the rotating directions of the photosensitive drum 1 and the developing roller 8 are the same at a contact portion between both. The developer feed roller 12 is rotated in contact with and in the same direction C as the developing roller 8 to supply the developer to the outer periphery of the developing roller 8.

A blade 9 as a layer-thickness regulating means for developer is arranged at a position between the contact point with the feed roller 12 and the contact point with the photosensitive drum 1 on the periphery of the developing roller 8. The blade 9 is composed of conductive rubber or stainless steel, and voltage of |200 V| to |600 V| is applied to the blade 9 to charge the developer. Therefore, the resistivity of the blade 9 is preferably $10^6$ Ωcm or lower.

The non-magnetic one-component developer 10 according to the present invention is contained in the casing 11 of the image forming apparatus. The non-magnetic one-component developer 11 comprises the polymerized toner described above. Since the polymerized toner according to the present invention has a relatively sharp particle diameter distribution, the developer layer formed on the developing roller 8 can be made a thin layer of a substantially single layer or 2 layers by the layer-thickness regulating means, thereby forming reproducible images with good quality.

The transfer roller 6 serves to transfer the developer image formed on the surface of the photosensitive drum 1 by the developing roller 8 to a transfer medium 7. Examples of the transfer medium 7 include paper and OHP sheets. As the transferring means, may be mentioned a corona discharge device and a transfer belt in addition to the transfer roller 6.

The developer image transferred to the transfer medium is fixed to the transfer medium by a fixing means (not illustrated). The fixing means is generally composed of a heating means and a press-bonding means. The developer transferred to the transfer medium is heated by the heating means to melt the developer (polymerized toner), and the molten polymerized toner is pressed against the transfer medium by means of the press-bonding means, thereby fixing the toner image thereto.

As a method for enhancing the charging properties of the developer, may be mentioned a method in which the rotating directions of the photosensitive member 1 and the developing roller 8 are made equal at a contact portion between both, and the circumferential speed of the developing roller 8 is increased to preferably at least 1.1 times, more preferably at least 1.3 times of the circumferential speed of the photosensitive member 1. A nip between the developer roller 8 and the photosensitive member 1 is preferably at least 1 mm. If the nip is too small, frictional force becomes weak. The surface hardness of the developer roller 8 is preferably at least 40 (based on JIS A). If the surface hardness of the developer roller 8 is too low, frictional force becomes weak.

The developer roller 8 is preferably such that at least the surface thereof formed of a rubber elastic member, the surface roughness in a circumferential direction be at most 10 μm, and the surface roughness in an axial direction be at most 10 μm. If the surface roughness is greater than 10 μm, thickness irregularities of the thin developer layer are easy to occur due to the surface irregularities of the developer roller 8. In addition, the triboelectrification properties are different between a thick portion and a thin portion, and so charge levels of the developer particles (polymerized toner) become varied from each other, resulting in deterioration of image quality.

No particular limitation is imposed on the material of the elastic member forming the surface of the developer roller 8. For example, styrene-butadiene copolymer rubber, acrylonitrile-butadiene copolymer rubber, acrylic rubber, epichlorohydrin rubber, urethane rubber or silicone rubber is however used.

No particular limitation is imposed on the means for controlling the surface roughness of the developer roller 8 within the above-described range. However, examples thereof include a method in which the peripheral surface of the developer roller 8 is polished by a cylindrical grinder, and a method in which the surface is polished then coated with a rubber elastic material.

In order to conduct development using this image forming apparatus in accordance with the cleaning system concurrent with development, in this reversal development system, reversal development is conducted by controlling the intensity of the respective surface potentials as described above, so as to satisfy the relationship of the following inequality (I):

$$|Vo|>|Ve|>|Vq| \quad \text{(I)}$$

Figure 3:
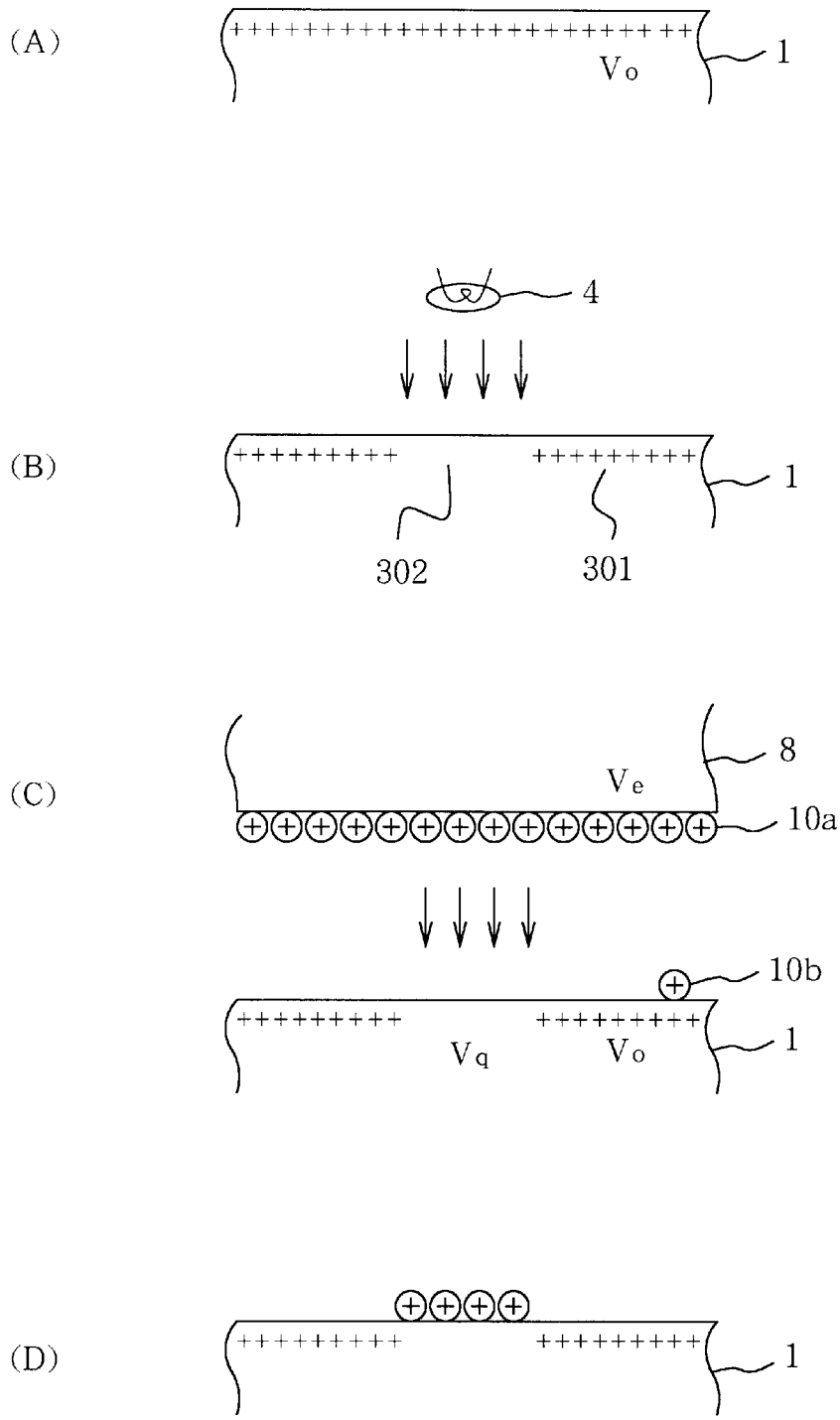
FIG. 3 is a schematic cross-sectional view illustrating the principle of a cleaning system concurrent with development in reversal development.

As illustrated in FIG. 3, the surface potential of the non-exposed region 301 and the surface potential of the exposed region 302 on the photosensitive member 1 are regarded as Vo and Vq, respectively. The development bias voltage applied to the developing roller 8 is regarded as Vb, and the surface potential Ve of the developing roller 8 is regarded as being equal to the bias voltage Vb. The electrostatic latent image on the photosensitive member is subjected to reversal development with the one-component developer (polymerized toner) charged to the same polarity as the polarity (i.e., the polarity of the photosensitive member charged) of the charge of the non-exposed region. FIG. 3 illustrates the case where the polarity of the photosensitive member charged and the charged polarity of the developer are both plus. However, they may be both minus.

EXAMPLES

The present invention will hereinafter be described more specifically by the following Examples and Comparative Examples. However, the present invention is not limited to these examples only. Incidentally, all designations of "part" or "parts" and "%" as will be used in the following examples mean part or parts by weight and % by weight unless expressly noted.

Physical properties in the following Examples and Comparative Examples were measured in accordance with the following respective methods.

(1) Particle Diameter of Toner

The volume average particle diameter, proportion of particles having a particle diameter of at most 5 μm, proportion of particles having a particle diameter of at least 16 μm and standard deviation of the number particle diameter distribution in each toner sample were measured by means of a Multisizer (manufactured by Coulter Co.). The measurement by the Multisizer was conducted under the following conditions:

aperture diameter: 100 μm;

medium: Isothone II, concentration: 10%; and number of particles measured: 50,000 particles.

(2) Evaluation as to Toner Form (Spheroidicity)

A photograph of a toner sample was taken by an scanning electron microscope, and the photograph was read in a nexus 9000 type image processing apparatus to divide the length (dl) of the toner by the breadth (ds) thereof, thereby regarding the value (dl/ds) as spheroidicity. At this time, the number of toner particles measured was 100.

(3) Evaluation as to Initial Image Quality (i) Measurement of Image Density (ID):

The evaluation of image density (ID) was conducted by measuring the image density of "black solid printed area" was measured by means of a McBeth reflection image densitometer in accordance with the following standard:

○: Not less than 1.3;

×: Less than 1.3.

(ii) Measurement of fog on photosensitive member:

A toner at a fogged portion on a photosensitive drum was transferred to paper by a mending tape to measure a reflectance value (a) by a whiteness meter. On the other hand, only a mending tape was stuck on paper to measure a reflectance value (b) by the whiteness meter. A difference (b−a) between both values was calculated out to evaluate the value in accordance with the following standard:

○: Less than 10%;

×: Not less than 10%.

(iii) Resolution:

A one-dot line and a one-dot white line were printed to visually observe whether their image qualities were reproduced or not through a light microscope, thereby evaluating each developer sample as to resolution in accordance with the following standard:

○: The one-dot line and the one-dot white line were reproduced;

Δ: The one-dot line and the one-dot white line were not reproduced, but a two-dot line and a two-dot white line were reproduced; and ×: Even the two-dot line and the two-dot white line were not reproduced.

(4) Evaluation as to Continuous Printing

Printing was continuously conducted from the beginning by means of the image forming apparatus illustrated in FIG. 1 to count the number of printed sheets that continuously retained an image density of 1.35 or higher as measured by a reflection densitometer (manufactured by McBeth Co.) and at an unprinted area, fog on a photosensitive member of less than 10% as measured by a whiteness meter (manufactured by Nippon Denshoku K.K.), thereby evaluating a toner sample used in accordance with the following standard:

○: The toner was such that the continuous printing could be conducted on 10,000 or more sheets;

×: The toner was such that the continuous printing could not be conducted on 10,000 sheets.

Example 1

1. Synthesis of Charge Control Resin:

A flask was charged with 700 parts of methanol, 200 parts of toluene, 87 parts of styrene, 10 parts of butyl acrylate, 3 parts of 2-acrylamido-2-methylpropanesulfonic acid and 2 parts of azobisdimethylvaleronitrile, and the resultant mixture was stirred to conduct a reaction at 90° C. for 8 hours. After the reaction, the solvent was then removed by distillation under reduced pressure to obtain a sulfonic group-containing copolymer having a weight average molecular weight (Mw) of 21,000, a styrene content of 87%, an n-butyl acrylate content of 10% and a 2-acrylamido-2-methylpropanesulfonic acid content of 3%.

2. Preparation of Monomer Composition for Core:

A mixture composed of 80.5 parts of styrene, 19.5 parts of n-butyl acrylate, 7 parts of carbon black ("#25B", trade name; product of Mitsubishi Kagaku Co., Ltd.; primary particle diameter: 40 nm), 1 part of the sulfonic group-containing copolymer, 0.3 parts of divinylbenzene, and 10 parts of pentaerythritol tetramyristate was stirred and mixed by an ordinary stirring device and then uniformly dispersed by means of a media type dispersing machine to obtain a monomer composition (liquid mixture) for core.

3. Preparation of Aqueous Dispersion Medium Containing Dispersion Stabilizer:

An aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare an aqueous dispersion medium containing magnesium hydroxide colloid (colloid of hardly water-soluble metal hydroxide). The particle diameter distribution of the colloid formed was measured by means of a microtrack particle diameter distribution measuring device (manufactured by Nikkiso Co., Ltd.) and found to be 0.36 μm in terms of $D_{50}$ and 0.80 μm in terms of $D_{90}$. The measurement by means of the microtrack particle diameter distribution measuring device was performed under the following conditions:

measuring range: 0.12 to 704 μm;

measuring time: 30 seconds; and medium: ion-exchanged water.

4. Preparation of Aqueous Dispersion of Monomer for Shell:

Three parts of methyl methacrylate (calculated Tg of the resulting polymer=105° C.) and 100 parts of water were subjected to a finely dispersing treatment by an ultrasonic emulsifier, thereby obtaining an aqueous-dispersion of a monomer for shell. The droplet diameter of droplets of the monomer for shell was found to be 1.6 μm in terms of $D_{90}$ as determined by means of a microtrack particle diameter distribution measuring device by adding the resultant droplets at a concentration of 3% to a 1% aqueous solution of sodium hexametaphosphate.

5. Formation of Droplets:

The monomer composition for core obtained above was poured into the colloidal dispersion of magnesium hydroxide obtained above, the mixture was stirred until droplets became stable, and 6 parts of t-butyl peroxy-2-ethylhexanoate were added as a polymerization initiator thereto. The resultant dispersion was stirred at 15,000 rpm under high shearing force by means of a Ebara Milder to form droplets of the monomer composition for core.

6. Suspension Polymerization:

The aqueous dispersion containing the thus-formed droplets of the monomer composition for core was charged into a 10-L reactor equipped with an agitating blade to initiate a polymerization reaction at 90° C. At the time the conversion of the monomer into a polymer reached almost 100%, sampling was conducted to measure the particle diameter of colored polymer particles (core particles) formed. As a result, the particle diameter of the core particles was found to be 6.4 μm.

The reactor was charged with the aqueous dispersion of the monomer for shell and a solution with 0.3 parts of 2,2'-azobis[2-methyl-N-(2-hydroxyethyl)-propionamide] as a water-soluble polymerization initiator dissolved in 65 parts of distilled water. After the reaction was continued for 8 hours, the reaction was stopped to obtain an aqueous dispersion of polymer particles having a pH of 9.5.

While stirring the aqueous dispersion of polymer particles, the pH of the system was adjusted to about 5.0 with sulfuric acid, and acid washing (at 25° C. for 10 minutes) was conducted. After the thus-treated aqueous dispersion was then filtered and dehydrated, washing water was sprayed on the residue to conduct water washing. Thereafter, the thus-treated residue was dried for 2 days by a dryer (at 45° C.) to obtain dry polymer particles. The polymer particles were subjected to a classifying treatment to remove parts of fine particles and coarse particles.

The polymer particles thus obtained were such that the volume average particle diameter was 6.5 μm, the proportion of particles having a particle diameter of at most 5 μm was 20% by number, the proportion of particles having a particle diameter of at least 16 μm was 1.2% by volume, the standard deviation of the number particle diameter distribution was 1.7, and the ratio (dl/ds) of the length to the breadth was 1.2. The polymer particles were substantially spherical polymerized toner particles having a core·shell structure.

7. Preparation of Non-Magnetic One-Component Developer:

To 100 parts of the polymer particles (polymerized toner) obtained above were added,0.3 parts of great-diameter silica ("RX-50", trade name; product of Nippon Aerosil Co., Ltd.; particle diameter: 40nm, product treated with HMDS) and 0.5 parts of colloidal silica ("R202", trade name; product of Degussa AG; particle diameter: 14 nm, product treated with HMDS), and they were mixed by means of a Henschel mixer to prepare a non-magnetic one-component developer.

8. Evaluation as to Printing:

The non-magnetic one-component developer (toner) obtained above was evaluated as to printing by means of a negatively charged printer of a cleaning system concurrent with development (non-magnetic one-component contact developing cleanerless system) that a photosensitive member and a developing roller are rotated in the same direction at their contact portion, and the circumferential speed of the developing roller is 1.5 times of the circumferential speed of the photosensitive member. As a result, good image quality was achieved in an initial stage. Further, 10,000-sheet continuous printing was conducted to evaluate the developer. As a result, good image quality free of fog and blur was achieved. Neither lowering of resolution nor occurrence of white stripes were also observed. The evaluation results are shown in Table 1.

Example 2

An experiment was conducted in the same manner as in Example 1 except that in the step of "3. Preparation of aqueous dispersion medium containing dispersion stabilizer", an aqueous solution with 5.2 parts, in place of 5.8 parts, of sodium hydroxide (alkali metal hydroxide) dissolved in 50 parts of ion-exchanged water was gradually added to an aqueous solution with 8.5 parts, in place of 9.5 parts, of magnesium chloride (water-soluble polyvalent metallic salt) dissolved in 250 parts of ion-exchanged water under stirring to prepare an aqueous dispersion medium containing magnesium hydroxide colloid (colloid of hardly water-soluble metal hydroxide).

The polymer particles thus obtained were such that the volume average particle diameter was 7.6 μm, the proportion of particles having a particle diameter of at most 5 μm was 18% by number, the proportion of particles having a particle diameter of at least 16 μm was 1.0% by volume, the standard deviation of the number particle diameter distribution was 1.6, and the ratio (dl/ds) of the length to the breadth was 1.2.

The polymer particles obtained in the above-described manner were subjected to the same external additive treatment as in Example 1 to obtain a non-magnetic one-component developer. This non-magnetic one-component developer was evaluated as to printing in the same manner as in Example 1. As a result, good image quality was achieved in an initial stage. Further, 10,000-sheet continuous printing was conducted to evaluate the developer. As a result, good image quality free of fog and blur was achieved. Neither lowering of resolution nor occurrence of white stripes were also observed. The evaluation results are shown in Table 1.

Example 3

An experiment was conducted in the same manner as in Example 1 except that in the step of "3. Preparation of aqueous dispersion medium containing dispersion stabilizer", an aqueous solution with 5.2 parts, in place of 5.8 parts, of sodium hydroxide (alkali metal hydroxide) dissolved in 50 parts of ion-exchanged water was gradually added to an aqueous solution with 8.5 parts, in place of 9.5 parts, of magnesium chloride (water-soluble polyvalent metallic salt) dissolved in 250 parts of ion-exchanged water under stirring to prepare an aqueous dispersion medium containing magnesium hydroxide colloid (colloid of hardly water-soluble metal hydroxide).

The polymer particles thus obtained were such that the volume average particle diameter was 8.4μm, the proportion of particles having a particle diameter of at most 5 μm was 22% by number, the proportion of particles having a particle diameter of at least 16 μm was 1.3% by volume, the standard deviation of the number particle diameter distribution was 1.7, and the ratio (dl/ds) of the length to the breadth was 1.1.

The polymer particles obtained in the above-described manner were subjected to the same external additive treatment as in Example 1 to obtain a non-magnetic one-component developer. This non-magnetic one-component developer was evaluated as to printing in the same manner as in Example 1. As a result, good image quality was achieved in an initial stage. Further, 10,000-sheet continuous printing was conducted to evaluate the developer. As a result, good image quality free of fog and blur was achieved. Neither lowering of resolution nor occurrence of white stripes were also observed. The evaluation results are shown in Table 1.

Comparative Example 1

Polymer particles were obtained in the same manner as in Example 1 except that the classifying treatment for removing fine particles was not carried out.

The polymer particles thus obtained were such that the volume average particle diameter was 6.4 μm, the proportion of particles having a particle diameter of at most 5 μm was 32% by number, the proportion of particles having a particle diameter of at least 16 μm was 1.2% by volume, the standard deviation of the number particle diameter distribution was 2.1, and the ratio (dl/ds) of the length to the breadth was 1.1.

The polymer particles obtained in the above-described manner were subjected to the same external additive treatment as in Example 1 to obtain a non-magnetic one-component developer. This non-magnetic one-component developer was evaluated as to printing in the same manner as in Example 1. As a result, good image quality was achieved in an initial stage. However, when 10,000-sheet continuous printing was conducted to evaluate the developer, fog and blur increased, the image quality was unfit for practical use. The evaluation results are shown in Table 1.

Comparative Example 2

Polymer particles were obtained in the same manner as in Example 1 except that the classifying treatment for removing coarse particles was not carried out.

The polymer particles thus obtained were such that the volume average particle diameter was 7.6 μm, the proportion of particles having a particle diameter of at most 5 μm was 21% by number, the proportion of particles having a particle diameter of at least 16 μm was 3.2% by volume, the standard deviation of the number particle diameter distribution was 1.7, and the ratio (dl/ds) of the length to the breadth was 1.2.

The polymer particles obtained in the above-described manner were subjected to the same external additive treatment as in Example 1 to obtain a non-magnetic one-component developer. This non-magnetic one-component developer was evaluated as to printing in the same manner as in Example 1. As a result, good image quality was achieved in an initial stage. However, when 10,000-sheet continuous printing was conducted to evaluate the developer, resolution lowered, white stripes occurred, and the image quality was unfit for practical use. The evaluation results are shown in Table 1.

Comparative Example 3

Ground Toner

Hundred parts of a styrene resin ("SBM-600", trade name; product of Sanyo Chemical Industries, Ltd.), 7 parts of carbon black ("Monaque 120", trade name; product of Cabot Co.) and 0.5 parts of a charge control agent ("Spiron Black TRH", trade name; product of Hodogaya Chemical Co., Ltd.) were mixed and kneaded, and the resulting mixture was ground and then classified to obtain a black ground toner.

The ground toner thus obtained was such that the volume average particle diameter was 8.5 μm, the proportion of particles having a particle diameter of at most 5 μm was 23% by number, the proportion of particles having a particle diameter of at least 16 μm was 1.2% by volume, and the standard deviation of the number particle diameter distribution was 1.6. In this ground toner, the ratio (dl/ds) of the length to the breadth was 1.4, and the form thereof was hence indefinite.

To 100 parts of the ground toner obtained above were added 0.3 parts by weight of great-diameter silica ("RX-50", trade name; product of Nippon Aerosil Co., Ltd.; particle diameter: 40 μm, product treated with HMDS) and 0.5 parts of colloidal silica ("R202", trade name; product of Degussa AG; particle diameter: 14 nm, product treated with DMPS), and they were mixed by means of a Henschel mixer to prepare a non-magnetic one-component developer. This non-magnetic one-component developer was evaluated as to printing. As a result, fog and blur occurred from the beginning, and the image quality thereof was unfit for practical use. The results are shown in Table 1.

TABLE 1

| | Example | | | Comp. Example | | |
|---|---|---|---|---|---|---|
| | 1 | 2 | 3 | 1 | 2 | 3 |
| <Polymerized toner> | | | | | | |
| Volume average particle diameter (μm) | 6.5 | 7.6 | 8.4 | 6.4 | 7.6 | 8.5 |
| Proportion of particles of at most 5 μm (% by number) | 20 | 18 | 22 | 32 | 21 | 23 |
| Proportion of particles of at least 16 μm (% by volume) | 1.2 | 1.0 | 1.3 | 1.2 | 3.2 | 1.2 |
| Standard deviation of number particle diameter distribution | 1.7 | 1.6 | 1.7 | 2.1 | 1.7 | 1.6 |
| spheroidicity | 1.2 | 1.2 | 1.1 | 1.1 | 1.2 | 1.4 |
| Circumferential speed ratio (developing roller/photosensitive member) | 1.5 | 1.5 | 1.5 | 1.5 | 1.5 | 1.5 |
| <Initial image> | | | | | | |
| Image density | ○ | ○ | ○ | ○ | ○ | X |
| Fog | ○ | ○ | ○ | ○ | ○ | X |
| Resolution | ○ | ○ | ○ | ○ | Δ | X |
| <Continuous printing> | ○ | ○ | ○ | X | X | X |

INDUSTRIAL APPLICABILITY

According to the present invention, there are provided non-magnetic one-component developers suitable for use in the cleaning system concurrent with development. The non-magnetic one-component developers according to the present invention do not cause lowering of flowability and image quality even in continuous printing or long-term repeated printing when they are applied to the developing method according to the cleaning system concurrent with development. According to the present invention, there is provided a developing method which is a developing method according to the cleaning system concurrent with development and does not cause fog and blur in the resulting image by continuous printing or long-term repeated printing. The non-magnetic one-component developers according to the present invention exhibit good image quality and stable durability when they are applied to the cleaning system concurrent with development in a developing device in which the circumferential speed of a developing roller is at least 1.1 times of the circumferential speed of a photosensitive member.

What is claimed is:

1. A non-magnetic one-component developer comprising a substantially spherical polymerized toner which contains at least a binder resin and a colorant and has the following features:

(a) the volume average particle diameter being 5 to 10 μm;

(b) the proportion of particles having a particle diameter of at most 5 μm being at most 25% by number;

(c) the proportion of particles having a particle diameter of at least 16 μm being at most 2% by volume;

(d) the standard deviation of the number particle diameter distribution being at most 1.8; and (e) the spheroidicity represented by a ratio (dl/ds) of a length (dl) to a breadth (ds) in a particle being 1.0 to 1.3.

2. The non-magnetic one-component developer according to claim 1, wherein the developer is adapted for use in a cleaning system concurrent with development.

3. The non-magnetic one-component developer according to claim 2, wherein the cleaning system concurrent with development comprises arranging a developing roller carrying a developer charged to the same polarity as the charged polarity of the charged surface of a photosensitive member in contact with the photosensitive member, exposing the photosensitive member, and then developing an exposed region on the photosensitive member with the developer, and at the same time removing a remaining developer adhered to a non-exposed region on the photosensitive member by suction on the side of the developer roller to conduct cleaning.

4. The non-magnetic one-component developer according to claim 1, wherein the polymerized toner is obtained by subjecting a monomer composition containing at least a polymerizable monomer and a colorant to suspension polymerization in an aqueous dispersion medium containing a dispersion stabilizer.

5. The non-magnetic one-component developer according to claim 4, wherein the dispersion stabilizer is colloid of a hardly water-soluble metallic compound.

6. The non-magnetic one-component developer according to claim 1, wherein the polymerized toner has a core·shell structure.

7. The non-magnetic one-component developer according to claim 6, wherein the polymerized toner having the core·shell structure is obtained by subjecting a monomer composition containing at least a polymerizable monomer for core and a colorant to suspension polymerization in an aqueous dispersion medium containing a dispersion stabilizer, and using the resultant colored polymer particles as a core to subject a polymerizable monomer for shell to suspension polymerization in the presence of the core.

8. The non-magnetic one-component developer according to claim 7, wherein a weight ratio of the polymerizable monomer for core to the polymerizable monomer for shell is 80:20 to 99.9:0.1.

9. The non-magnetic one-component developer according to claim 7, wherein the glass transition temperature of a polymer obtained by polymerizing the polymerizable monomer for shell is higher than the glass transition temperature of a polymer obtained by polymerizing the polymerizable monomer for core.

10. The non-magnetic one-component developer according to claim 1, wherein the polymerized toner further comprises a charge control resin containing a polar group and soluble in the polymerizable monomer.

11. A developing method comprising arranging a developing roller carrying a developer charged to the same polarity as the charged polarity of the charged surface of a photosensitive member in contact with the photosensitive member, exposing the photosensitive member, and then developing an exposed region on the photosensitive member with the developer, and at the same time removing a remaining developer adhered to a non-exposed region on the photosensitive member by suction on the side of the developing roller to conduct cleaning, wherein the developer is a non-magnetic one-component developer comprising a substantially spherical polymerized toner which contains at least a binder resin and a colorant and has the following features:

(a) the volume average particle diameter being 5 to 10 $\mu$m;

(b) the proportion of particles having a particle diameter of at most 5 $\mu$m being at most 25% by number;

(c) the proportion of particles having a particle diameter of at least 16 $\mu$m being at most 2% by volume;

(d) the standard deviation of the number particle diameter distribution being at most 1.8; and (e) the spheroidicity represented by a ratio (dl/ds) of a length (dl) to a breadth (ds) in a particle being 1.0 to 1.3.

12. The developing method according to claim 11, wherein the photosensitive member and the developing roller are rotated in the same direction as each other at the contact portion thereof, and the rotational ratio between both can be controlled.

13. The developing method according to claim 11, wherein the polymerized toner is obtained by subjecting a monomer composition containing at least a polymerizable monomer and a colorant to suspension polymerization in an aqueous dispersion medium containing a dispersion stabilizer.

14. The developing method according to claim 13, wherein the dispersion stabilizer is colloid of a hardly water-soluble metallic compound.

15. The developing method according to claim 11, wherein the polymerized toner has a core·shell structure.

16. The developing method according to claim 15, wherein the polymerized toner having the core·shell structure is obtained by subjecting a monomer composition containing at least a polymerizable monomer for core and a colorant to suspension polymerization in an aqueous dispersion medium containing a dispersion stabilizer, and using the resultant colored polymer particles as a core to subject a polymerizable monomer for shell to suspension polymerization in the presence of the core.

17. The developing method according to claim 16, wherein a weight ratio of the polymerizable monomer for core to the polymerizable monomer for shell is 80:20 to 99.9:0.1.

18. The developing method according to claim 17, wherein the glass transition temperature of a polymer obtained by polymerizing the polymerizable monomer for shell is higher than the glass transition temperature of a polymer obtained by polymerizing the polymerizable monomer for core.

19. The developing method according to claim 11, wherein the polymerized toner further comprises a charge control resin containing a polar group and soluble in the polymerizable monomer.

* * * * *